US008192565B2

(12) United States Patent
Masuda et al.

(10) Patent No.: US 8,192,565 B2
(45) Date of Patent: Jun. 5, 2012

(54) STEEL FOR MACHINE AND STRUCTURAL USE HAVING EXCELLENT MACHINABILITY AND PROCESS FOR PRODUCING THE SAME

(75) Inventors: Tomokazu Masuda, Kobe (JP); Takehiro Tsuchida, Kobe (JP); Masaki Shimamoto, Kobe (JP); Motohiro Horiguchi, Kobe (JP); Shinsuke Masuda, Kobe (JP); Koichi Akazawa, Kobe (JP); Shogo Murakami, Kobe (JP); Mutsuhisa Nagahama, Kobe (JP); Hiroshi Yaguchi, Kobe (JP); Koichi Sakamoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/665,228

(22) PCT Filed: Jun. 23, 2008

(86) PCT No.: PCT/JP2008/061405

§ 371 (c)(1),
(2), (4) Date: Dec. 17, 2009

(87) PCT Pub. No.: WO2009/001792

PCT Pub. Date: Dec. 31, 2008

(65) Prior Publication Data

US 2010/0193090 A1 Aug. 5, 2010

(30) Foreign Application Priority Data

Jun. 28, 2007 (JP) ..... 2007-170936
Apr. 25, 2008 (JP) ..... 2008-115575

(51) Int. Cl.
*C21D 6/00* (2006.01)

(52) U.S. Cl. ..... 148/622; 148/333; 148/334; 148/332

(58) Field of Classification Search ..... None
See application file for complete search history.

(56) References Cited

U.S. PATENT DOCUMENTS 6,579,385 B2 6/2003 Yaguchi et al.
(Continued)

FOREIGN PATENT DOCUMENTS

JP 9 176784 7/1997
(Continued)

OTHER PUBLICATIONS

U.S. Appl. No. 12/809,107, filed Jun. 18, 2010, Sakamoto, et al.
(Continued)

*Primary Examiner* — Patrick Ryan
*Assistant Examiner* — Yoshitoshi Takeuchi
(74) *Attorney, Agent, or Firm* — Oblon, Spivak, McClelland, Maier & Neustadt, L.L.P.

(57) ABSTRACT

The present invention provides a steel for machine and structural use which is capable of maintaining mechanical characteristics such as strength by reducing a S content as well as of exhibiting excellent machinability (particularly tool life) in intermittent cutting (such as hobbing) with the high speed tool, and a method useful for producing the steel for machine and structural use. The steel for machine and structural use according to the invention secures 0.002% or more of solute N in the steel and has a chemical composition which is appropriately adjusted and satisfies a relationship of the following expression (1): $(0.1\times[Cr]+[Al])/[O]\geqq 150$ . . . (1), in which [Cr], [Al], and [0] represent a Cr content (mass %), an Al content (mass %), and an O content (mass %), respectively.

13 Claims, 1 Drawing Sheet

U.S. PATENT DOCUMENTS

| | | | | |
|---|---|---|---|---|
| 6,596,227 | B2 | 7/2003 | Shindo et al. | |
| 6,706,419 | B2 * | 3/2004 | Yoshinaga et al. | 428/659 |
| 2007/0044867 | A1 | 3/2007 | Yaguchi et al. | |

FOREIGN PATENT DOCUMENTS

| | | | |
|---|---|---|---|
| JP | 11 229032 | | 8/1999 |
| JP | 2001 342539 | | 12/2001 |
| JP | 2003 226932 | | 8/2003 |
| JP | 2004-143579 | * | 5/2004 |
| JP | 2004 143579 | | 5/2004 |

OTHER PUBLICATIONS

U.S. Appl. No. 13/321,902, filed Nov. 22, 2011, Tsuchida, et al.
Office Action issued Oct. 19, 2011, in Korean Patent Application No. 10-2009-7026823 filed Jun. 23, 2008 (with English translation).

* cited by examiner

STEEL FOR MACHINE AND STRUCTURAL USE HAVING EXCELLENT MACHINABILITY AND PROCESS FOR PRODUCING THE SAME

TECHNICAL FIELD

The present invention relates to a steel for machine and structural use which is subjected to cutting for producing machine parts. More specifically, the invention relates to a steel for machine and structural use exhibiting excellent machinability in intermittent cutting such as hobbing and being free from a reduction in toughness even after undergoing a surface hardening processing such as carburizing and carbonitriding.

BACKGROUND ART

In general, a gear, a shaft, a pulley, a constant velocity joint, and the like which are used for various gear transmission devices such as an automobile transmission and a differential as well as structural parts such as a crankshaft and a connecting rod are formed into an ultimate shape after being subjected to a processing such as forging and a cutting processing in this order. Since a cost required for the cutting processing has a large proportion in a manufacture cost, a steel material forming the structural parts is required to have excellent machinability.

In the structural parts as described above, predetermined strength is ensured by forming the structural parts into the ultimate shape, and then subjecting them to a surface hardening treatment such as carburizing and carbonitriding (including atmospheric, low pressure, vacuum, and plasma carbonitriding) and, according to the necessity, followed by quenching-tempering, induction heating and quenching, or the like. However, a lowering in strength can occur during such processings. Particularly, there is a problem that the steel material is liable to be lowered in strength in a direction perpendicular to a rolling direction (this direction is generally referred to as "transverse direction").

Lead (Pb) has heretofore been known as an element improving the machinability without reducing the strength of steels for machine and structural use, and Pb is remarkably effective for the machinability improvement. However, since Pb is harmful to living body and has problems in processings such as Pb fume during melting and cutting waste, there is a demand for excellent machinability which is achieved without adding Pb (Pb free).

As a technology for ensuring excellent machinability without adding Pb, a steel material having an S content increased to about 0.06% has been known. However, in this case, since there is a problem that mechanical characteristics (toughness, fatigue strength) are liable to be lowered, the increase in S content has limitation. Such problem is considered to occur due to a reduction in toughness in transverse direction that is caused by expansion of sulfide (MnS) in a rolling direction. Particularly, in the parts which are required to have high strength, it is necessary to reduce the S content to an amount as small as possible. In view of above, it is necessary to establish a technology for improving machinability without actively adding Pb and S. Under the circumstances, various technologies for achieving excellent machinability without actively adding Pb and S have been proposed.

Incidentally, in a production process of a gear which is one of the structural parts, a steel (material) for machine and structural use generally undergoes forging, rough cutting by hobbing, and finishing by shaving, followed by a heat treatment such as carburizing and polishing (honing) again. However, since heat treatment distortion frequently occurs in such process, it is difficult to adjust such heat treatment distortion only by the polishing, and dimensional accuracy of the part is reduced in some cases. Recently, excellent dimensional accuracy has been in demand in view of countermeasure for suppressing noise of gears in use. As the countermeasure for this, grinding (hard finishing) is in some cases performed in advance of the polishing.

In any of the production processes, the considerably large number of process steps is required, and a cost required for the cutting and grinding is increased, thereby raising a great need for cost reduction of the process as a whole. Therefore, a cost reduction is required in each of the process steps, and there is a great expectation for a steel that enables such cost reductions. Particularly, in view of the high tool cost in the hobbing that is performed in both of the processes, there is a great expectation for a technology for improving tool life.

The hobbing is equivalent to intermittent cutting, and, as a tool for the hobbing, a tool obtained by coating AlTiN or the like on a high speed tool steel (hereinafter sometimes referred to as high speed tool) is mainly used at present. In contrast, since a tool obtained by coating AlTiN or the like on a cemented carbide (hereinafter sometimes referred to as carbide tool) has a problem that edge chipping often occurs when used for normalized materials, the tool is usually used for continuous cutting such as turning.

Since the intermittent cutting and the continuous cutting are different from each other in cutting mechanism, the tool suitable for each of the cuttings is selected, and it is desirable that the steel for machine and structural use used as a material to be machined has a property for exhibiting excellent machinability in both of the cuttings. However, gear cutting by the hobbing (intermittent cutting) using the high speed tool has a drawback that the tool is subject to oxidation and wear at a low speed and a low temperature as compared to the case of turning which is the continuous cutting using the carbide tool. Therefore, particularly a tool life among the machinability is required to be improved in the steel for machine and structural use undergoing the intermittent cutting such as the hobbing.

However, actual situation is such that an improvement in machinability in the intermittent cutting, particularly, a technology for improving machinability in the intermittent cutting in the case of low cutting speed, has not been established yet. As a technology for improving machinability, for example, JP-A-2001-342539 discloses a steel material excellent in intermittent cutting (tool life) at a high speed (cutting speed: 200 m/min or more) which is obtained by including 0.04 to 0.20% of Al and 0.0030% or less of O. An intermittent high speed cutting steel which achieves excellent intermittent cutting at high speed was realize by the technology. However, the technology is basically on the assumption of cutting with a carbide tool (with the use of carbide tool P10 (JIS B4053)), and machinability with a high speed tool at a low speed cutting (low temperature cutting) thereof is insufficient.

Also, JP-A-2003-226932 discloses a steel material that enables excellent high speed cutting in turning (continuous cutting) and milling (intermittent cutting) by containing 0.001% to 0.040% of S, 0.04% to 0.20% of Al, and 0.0080% to 0.0250% of N as well as by controlling a ratio ([Al]/[N]) between an Al content [Al] and a N content [N] to 2.0 to 15.0. However, the technology is basically on the assumption of cutting with a carbide tool (with the use of carbide tool P10) as is the case with the above-mentioned technology, and machinability with a high speed tool at a low speed cutting thereof is insufficient.

JP-A-11-229032 discloses an improvement in machinability such as a capability of drilling that is achieved by controlling a chemical composition in a steel for soft nitriding to high Cr (0.5 to 2%) and high Al (0.01 to 0.3%) as well as by controlling a maximum diameter of Ti carbosulfide in the steel to 10 μm or less. However, the publication does not disclose any description about the intermittent cutting with high speed tool at low speed.

DISCLOSURE OF THE INVENTION

Problems that the Invention is to Solve

The present invention was accomplished in view of the above-described situation. An object of the invention is to provide a steel for machine and structural use which is capable of maintaining mechanical characteristics such as strength by reducing a S content as well as of exhibiting excellent machinability (particularly tool life) in intermittent cutting (such as hobbing) with a high speed tool and a method useful for producing the steel for machine and structural use.

Means for Solving the Problems

A steel for machine and structural use according to the invention for attaining the above-described object has gist in that the steel includes 0.05 to 1.2% of C (% means mass %, same applies to the following description), 0.03 to 2% of Si, 0.2 to 1.8% of Mn, 0.03% or less (excluding 0%) of P, 0.03% or less (excluding 0%) of S, 0.1 to 3% of Cr, 0.06 to 0.5% of Al, 0.004 to 0.025% of N, 0.003% or less (excluding 0%) of O, at least one of 0.0005 to 0.02% of Ca and 0.0001 to 0.005% of Mg and 0.002% or more of solute N in the steel, with a remainder being iron and inevitable impurities, in which the steel satisfies a relationship of the following expression (1):

$$(0.1\times[Cr]+[Al])/[O]\geqq 150 \quad (1),$$

in which [Cr], [Al], and [O] represent a Cr content (mass %), an Al content (mass %), and an O content (mass %), respectively.

In the steel for machine and structural use according to the invention, it is effective to further includes, according to the necessity, (a) 1.0% or less (excluding 0%) of Mo, (b) 0.15% or less (excluding 0%) of Nb, (c) at least one element selected from the group consisting of Ti, Zr, Hf, and Ta in a total amount of 0.02% or less (excluding 0%), (d) at least one element selected from the group consisting of 0.5% or less (excluding 0%) of V, 3% or less (excluding 0%) of Cu, 3% or less (excluding 0%) of Ni, and 0.005% or less (excluding 0%) of B, and the like. Characteristics of the steel material are improved depending on the types of elements to be contained.

In order to produce the steel for machine and structural uses described above, a process for producing the steel for machine and structural use preferably including, as a solution treatment of N, heating a steel material to 1150° C. or more, followed by cooling the steel material in a temperature range of 900 to 500° C. at a cooling rate of 0.8 to 4° C./sec.

ADVANTAGE OF THE INVENTION

According to the invention, excellent strength is achieved by a reduction in S content, and inclusions as a whole are easily deformed at a low melting point by appropriate adjustment of the respective components of the inclusions. According to such constitution, it is possible to obtain a steel for machine and structural use capable of exhibiting excellent machinability (particularly tool life) in both of intermittent cutting with a high speed tool and continuous cutting with a carbide tool.

BEST MODE FOR CARRYING OUT THE INVENTION

Figure 1:
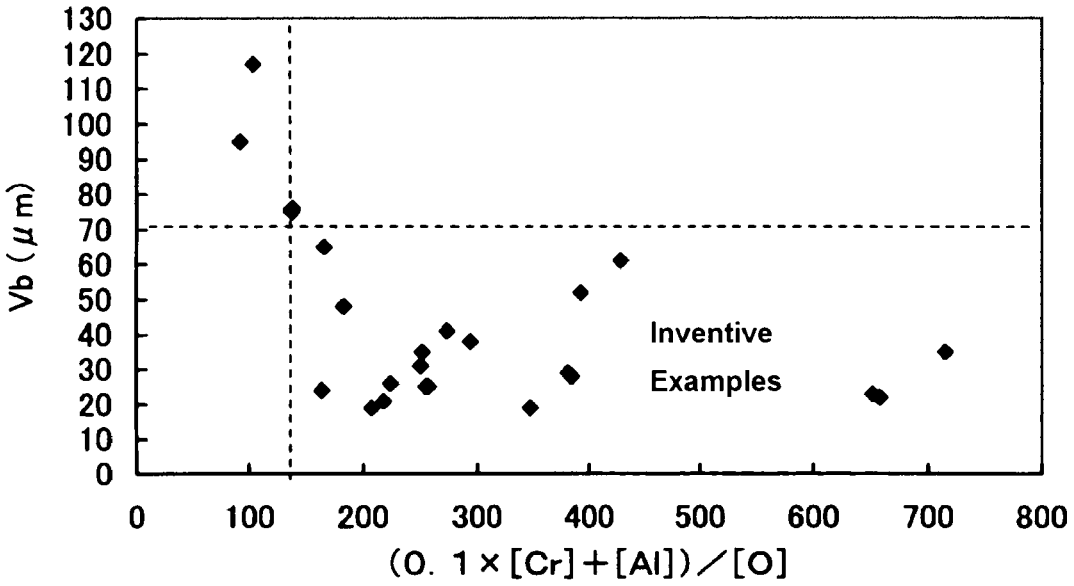
FIG. 1 is a graph showing a relationship between a value A {(0.1×[Cr]+[Al]/[O])} and a tool wear amount Vb.

For the purpose of improving machinability in the intermittent cutting at a low speed of a steel for machine and structural use, the inventors had conducted studies from various angles. As a result, the inventors found that it is possible to improve machinability (particularly tool life) of a steel for machine and structural use by appropriately controlling contents of Cr and Al and a ratio therebetween (relationship of the expression (1)) and appropriately adjusting a chemical composition of the steel, thereby accomplishing the invention. Reasons for limiting the range of the chemical composition defined in the invention are as follows.

C: 0.05 to 1.2%

C is an element effective for ensuring required core hardness of a part which is produced from the steel for machine and structural use. In order to exert such an effect, it is necessary to keep a C content to 0.05% or more. However, when the C content is excessive, since the hardness becomes too high, the machinability is lowered. Therefore, it is necessary to keep the C content to 1.2% or less. A lower limit of the C content is preferably 0.15%, and an upper limit of the C content is preferably 0.5%.

Si: 0.03 to 2%

Si is an element effective for improving internal quality of a steel material as a deoxidizing element. In order to exert such an effect, it is necessary to keep a Si content to 0.03% or more, preferably 0.1% or more. A large amount of Si, namely 1% or more of Si, acts effectively for tool protection film generation. However, when the Si content is excessive, abnormal structure is generated in carburization and it is difficult to achieve high hardness due to an increase in residual austenite (residual γ) amount after a heat treatment (quenching). Therefore, it is necessary to keep the Si content to 2% or less, preferably 1.5% or less.

Mn: 0.2 to 1.8%

Mn is an element effective for improving strength of a steel material by improving a hardenability during quenching. In order to effectively exert such an effect, it is necessary to contain 0.2% or more (preferably 0.5% or more) of Mn. However, when the Mn content is excessive, the hardenability during quenching is enhanced too much to deteriorate machinability due to generation of excessively cooled structure after quenching. Therefore, it is necessary to keep the Mn content to 1.8% or less (preferably 1.5% or less).

P: 0.03% or less (excluding 0%)

P is an element (impurity) which is inevitably contained in a steel material and promotes cracking during hot working, and it is preferable to reduce P to an amount as small as possible. Therefore, the P amount is set to 0.03% or less (more preferably 0.02% or less, further preferably 0.01% or less). It is industrially difficult to keep the P amount to 0%.

S: 0.03% or less (excluding 0%)

S is an element that improves machinability. However, when S is contained excessively, ductibility and toughness are lowered. Therefore, it is necessary to keep an upper limit of 5 to 0.03%. Particularly, when the S content is excessive, S reacts with Mn to form a MnS inclusion, and the inclusion deteriorates toughness in a direction orthogonal to the rolling (toughness in transverse direction) by expanding in the rolling direction during rolling. However, S is an impurity which is inevitably contained in steels, and it is industrially difficult to keep the S amount to 0%.

Al: 0.06 to 0.5%

Al is a strongly deoxidizing element and effective for improving internal quality of a steel material. Also, Al is an important element in the intermittent cutting since it is possible to prominently improve machinability by ensuring Al. In order to exert such effects, it is necessary to keep an Al content to 0.06% or more, preferably 0.1% or more, more preferably 0.2% or more, further preferably 0.3% or more. However, when the Al content is excessive, an amount of inclusion in a steel material is increased, and it is difficult to achieve high hardness due to an increase in residual austenite (residual γ) amount after a heat treatment (quenching). Therefore, it is necessary to keep the Al content to 0.5% or less.

Cr: 0.1 to 3%

Cr is an element effective for enhancing a hardenability during quenching and hardness of steel materials. Also, when Cr is added together with Al, an intermittent cutting property of the steel is effectively enhanced. In order to exert such effects, it is necessary to keep the Cr content to 0.1% or more. However, when a Cr content is excessive, machinability is lowered due to generation of coarse carbide and development of excessively cooled structure, it is necessary to keep the Cr content to 3% or less. A lower limit of the Cr content may be preferably 0.3%, more preferably 0.7%. An upper limit of the Cr content may be preferably 2.0%, more preferably 1.6%.

N: 0.004 to 0.025%

Oxidation wear of a tool is promoted by rapid oxidation of a newborn surface of a steel material which is adhered to the tool in the intermittent cutting, and N exhibits an effect of improving a tool life in the intermittent cutting by suppressing the reaction. Also, N exhibits an effect for suppressing an abnormal growth of austenitic grains during carburizing as well as for refining austenitic grains during heat treatment by forming AlN with Al. In order to exert such effects, it is necessary to contain 0.004% or more of N, and it is recommended to contain N in a preferred amount of 0.006%. However, when the N content is excessive, ductibility and toughness of the steel material are lowered due to age hardening. In view of the above, it is necessary to keep the N content to 0.025% or less, preferably 0.020% or less (more preferably 0.015% or less).

O: 0.003% or less (excluding 0%)

When an O content is excessive, a coarse oxide-based inclusion is generated to cause adverse influences on machinability, ductibility, toughness, hot processability, and ductibility of a steel. Therefore, an upper limit of the O content is set to 0.003% (preferably 0.002%).

Ca: 0.0005% to 0.02% and/or Mg: 0.0001% to 0.005%

Ca and Mg exhibit an action of suppressing tool wear by softening hard inclusions such as alumina. Also, Ca contributes to improvement in toughness in the direction orthogonal to the rolling by the action of spheroidizing MnS. In order to exert such effects, it is necessary to contain 0.0005% or more of Ca and 0.0001% or more of Mg. However, when Ca and Mg are contained excessively, ductibility and toughness are lowered due to an increase in inclusions. Therefore, it is necessary to keep Ca to 0.02% or less and Mg to 0.005 or less.

Solute N: 0.002% or more

In the steel for machine and structural use according to the invention, management of a predetermined amount of N in a solute state (solute N) is one of important requirements. From the view point of steel machinability, it has heretofore been considered that it is recommendable to reduce N to an amount as small as possible by fixing N with AlN or the like. However, according to the studies of the present inventors, it has been clarified that the machinability is further improved by solubilizing a part of N. It is considered that such effect is exhibited because a fluctuation of cutting resistance during cutting is suppressed by a reduction in hardness difference between a ferrite phase and other hard phases due to an increase in strength achieved by solubilization of N into ferrite.

In order to exert such effects by solute N, it is necessary to secure at least 0.002% or more, preferably 0.0045% or more (more preferably 0.005% or more), of solute N. An upper limit of the solute N amount is decided based on the total N amount. However, when the solute N amount is increased, toughness and ductibility start to be reduced along with an increase in strength of the steel material. In view of above, the solute N amount may be preferably 0.02% or less, more preferable 0.015% or less.

The content of solute N in the invention is a value decided by subtracting a N amount in a total nitride compounds from a total N amount in a wire material in accordance with JIS G 1228. Practical measurement methods for the solute N content will be described below.

(a) Inert Gas Melting Method—Heat Conductivity Method (Measurement of Total N Amount)

A sample cut out from a test specimen was placed in a furnace to extract N by melting the sample in an inert gas stream, and the extract was transferred to a heat conductivity cell to measure a change in heat conductivity, thereby detecting a total N amount.

(b) Absorption Spectroscopy Using Indophenol Blue Obtained by Separation by Distillation with Ammonium (Measurement of Amount of Total N Compounds)

A sample cut out from a test specimen was dissolved into a 10% AA-based electrolyte solution to perform constant current electrolysis for a measurement of an amount of total N compounds in a steel. The 10% AA-based electrolyte solution is a non-aqueous solvent-based electrolyte solution formed of 10% acetone, 10% tetramethylammonium chloride, and residual methanol, which is a solution that prevents formation of passivation film on a steel surface.

About 0.5 g of the sample of the test specimen was dissolved into the 10% AA-based electrolyte solution, and a generated insoluble residue (nitride compounds) was filtrated using a filter made from polycarbonate having a pore size of 0.1 μm. The thus-obtained insoluble residue was heated in sulfuric acid, potassium sulfide, and a pure copper chip for decomposition, and the decomposed matter was mixed with a filtrate. The thus-obtained solution was adjusted to be alkaline with sodium hydroxide, followed by water vapor distillation, and the distilled ammonium was absorbed by diluted sulfuric acid. Further, phenol, sodium hypochlorite, and sodium penta-cyano nitrosyl iron (III) acid were added to generate a blue complex, and absorbance was measured by using an absorptiometer to detect an amount of total compounds.

It is possible to detect a solute N amount by subtracting the amount of total N compounds from the total N amount detected by the method of (a).

Inevitable Impurities

The basic composition of the steel for machine and structural use of the invention is as described above, and the remainder is substantially iron. Incidentally, inclusion of inevitable impurities (e.g. Sn, As, H, etc.) which are contained depending on types of materials, resources, production equipments is considered acceptable.

Also, in the steel for machine and structural use of the invention, it is necessary that Cr, Al, and O satisfy a relationship of the following expression (1). The reasons for defining the following expression (1) will be described below.

$$(0.1\times[Cr]+[Al])/[O]\geqq 150 \quad (1),$$

in which [Cr], [Al], and [O] represent a Cr content (mass %), an Al content (mass %), and an O content (mass %), respectively.

A hard oxide in a steel causes abrasive wear at a boundary between a tool and a steel material during cutting as well as to entail a reduction in fatigue strength. Particularly, in the intermittent cutting at a low temperature range (i.e. low speed range) that is an issue of the invention, influence of the abrasive wear is great as a factor dominating the tool wear. Also, though oxidation wear of the tool is promoted due to rapid oxidation of a newborn surface of the steel material which is adhered to the tool in the intermittent cutting, it is possible to reduce the influence of the abrasive wear by an combined action of the solute Cr and Al in the steel.

In the high speed intermittent cutting, the tool wear is suppressed by generating a belag (non-metallic layer) containing mainly Al-containing oxides on a tool surface. On the other hand, it is necessary to suppress oxidation which causes such tool wear. Based on such findings, it was proved that the intermittent cutting at a low temperature is remarkably improved when the relationship of the expression (1) is satisfied according to the studies conducted by the present inventors.

Also, steels for machine and structural use, especially a case-hardened steel is ordinarily subjected to carburizing for hardening a surface, and abnormal grain growth can occur during the treatment due to a carburizing temperature, a carburizing time, a heating rate, and the like. An effect of suppressing such phenomenon is exhibited by increasing the Al content to an amount more than an ordinary value. Such effect is considered to be exhibited by the increase in Al content which causes a reduction in inter-grain distance of an AlN precipitate. Such effect is also effective for the case of performing a heat treatment other than the carburizing (e.g. quenching and tempering), resulting in the contribution to improvement in toughness.

The steel for machine and structural use of the invention is improved in intermittent cutting at low speed by the above-described appropriate control of the chemical composition. The steel for machine and structural use of the invention may contain the following selected elements according to the necessity. Characteristics of the steel material are further improved depending on the type of the element to be contained.

Mo: 1.0% or less (excluding 0%)

Mo is an element effective for suppressing generation of an imperfectly quenched microstructure by ensuring a hardenability during quenching of a matrix and may be contained in the steel according to the necessity. Such effect is enhanced with an increase in Mo content. However, when Mo is contained excessively, the hard microstructure is generated even after the annealing, and machinability was reduced. Therefore, the Mo content may be preferably 1.0% or less.

Nb: 0.15% or less (excluding 0%)

Although steels for machine and structural use, especially a case-hardened steel is ordinarily subjected to carburizing for hardening a surface, abnormal grain growth can occur during the treatment due to a carburizing temperature, a carburizing time, a heating rate, and the like. Nb has an effect of suppressing such phenomenon. The effect is enhanced with an increase in Nb content. However, when Nb is contained excessively, since hard carbide is generated, machinability is lowered. Therefore, the Nb content may be preferably 0.15% or less.

At least one element selected from the group consisting of Ti, Zr, Hf, and Ta in a total amount of 0.02% or less (excluding 0%)

Since Ti, Zr, Hf, and Ta have an effect of suppressing abnormal grain growth like Nb and may be contained in the steel according to the necessity. Such effect is enhanced with an increase in content (total amount of one or more) of the elements. However, when the content is excessive, since hard carbide is generated, machinability is lowered. Therefore, the total amount thereof may be preferably 0.02% or less.

At least one element selected from the group consisting of V: 0.5% or less (excluding 0%), Cu: 3% or less (excluding 0%), Ni: 3% or less (excluding 0%), and B: 0.005% or less (excluding 0%)

The elements are effective for achieving high strength by improvement in hardenability during quenching of a steel material and may be contained in the steel according to the necessity. Such effect is enhanced with an increase in content (total amount of one or more) of the elements. However, when the content is excessive, an hard microstructure is generated or ductibility and toughness are lowered. Therefore, each of the elements may be preferably contained in an amount not more than the above-specified amount.

With regard to the steel material of the invention, the control of the solute N content to the predetermined amount is one of important requirements, and conditions for the control of the solute N amount will be described later. In the case of manufacturing a steel material with an ordinary method, AlN starts to be precipitated at a high temperature since the Al content is higher than ordinary steels. In this case, since N is fixed by Al, it is almost impossible to allow the presence of the solute N with the ordinary production method. Also, since the size of AlN is increased due to cooling, it is considered that a tool wear amount (abrasive wear amount) due to the crude AlN is increased. The predetermined amount of the solute N is ensured by performing a heat treatment described below. Also, since AlN is reduced in size by the heat treatment, it is assumed that progression of the abrasive wear is suppressed.

As the N solubilizing treatment in the invention, a steel material is heated to 1150° C. or more, and then the steel material in a temperature range of 900 to 500° C. is cooled at a cooling rate of 0.8 to 4° C./sec. It is necessary to keep the heating temperature of the steel material to 1150° C. or more from the above-described view points. However, the hard microstructure is easily generated due to an increase in size of crystal grains which can easily be caused by a too high temperature, resulting in lowering in machinability. Therefore, the heating temperature may be preferably about 1300° C. or less. A lower limit of the heating temperature may be preferably 1200° C., more preferably 1250° C.

After the above-described heating, it is necessary to cool the steel material in the temperature range of 900 to 500° C. by the cooling rate of 0.8 to 4° C./sec. The temperature range means a temperature region formed by AlN, and it is possible to prevent an increase in size of the generated AlN by cooling the temperature range at the cooling rate of 0.8 to 4° C./sec. However, when the cooling rate is too high, since strength of the steel material is increased by an increase in generation proportion of a hard phase such as bainite and martensite to result in lowering of machinability, it is necessary to keep the cooling rate to 4° C./sec or less. A lower limit of the cooling rate may be preferably 0.9° C./sec, more preferably 1.0° C./sec. Also, an upper limit of the cooling rate may be preferably 3° C./sec, more preferably 2.5° C./sec.

Quenching, quenching after hot forging, and the like may be considered as the above-described heat treatment, and such process steps may be performed in such a manner as to satisfy the conditions of the above-specified heating temperature and cooling rate.

EXAMPLES

Hereinafter, the invention will be described more specifically in conjunction with examples, but the invention is not limited by the following examples. The invention can of course be put into practical use with appropriate modifications being added thereto within the scope complying with the context described in the foregoing and below, and the modifications are encompassed by the technical scope of the invention.

150 kg of each of steels of which chemical compositions are shown in Tables 1 and 2 was melted in a vacuum induction furnace, followed by casting an ingot having an upper surface of ϕ245 mm, a lower surface of ϕ210 mm, and a length of 480 mm, forging (soaking: 1250° C.× about 3 hours, heating for forging: 1000° C.× about 1 hour), cutting, and obtaining a squared steel having the size of 150 mm square and a length of 680 mm, thereby obtaining two types of forged materials (a) and (b) described below. In Tables 1 and 2, a value {(0.1×[Cr]+[Al])/[O]} of the left side of the expression (1) (hereinafter referred to as "A value") is also shown.

(a) Plate material having a thickness of 30 mm, a width of 155 mm, and a length of 100 mm.

(b) Round bar material having a diameter of 80 mm and a length of 100 mm.

TABLE 1

| Test | Steel Material Chemical Composition* (mass %) | | | | | | | | | | | | | | | | | |
|---|---|---|---|---|---|---|---|---|---|---|---|---|---|---|---|---|---|---|
| No. | C | Si | Mn | P | S | Al | Cu | Ni | Cr | Mo | V | N | Mg | Ca | O | Others | Solute N | A Value |
| 1 | 0.21 | 0.18 | 0.81 | 0.012 | 0.014 | 0.07 | 0 | 0 | 0.95 | 0.18 | 0 | 0.0107 | 0 | 0.001 | 0.0012 | — | 1.0061 | 138 |
| 2 | 0.2 | 0.18 | 0.82 | 0.013 | 0.015 | 0.07 | 0 | 0 | 1.12 | 0.18 | 0 | 0.0119 | 0.0001 | 0.0007 | 0.0011 | — | 0.0072 | 165 |
| 3 | 0.21 | 0.19 | 0.82 | 0.014 | 0.016 | 0.19 | 0 | 0 | 1.12 | 0.17 | 0 | 0.0103 | 0.0001 | 0.0035 | 0.0012 | — | 0.0057 | 151 |
| 4 | 0.2 | 0.05 | 0.83 | 0.015 | 0.015 | 0.27 | 0 | 0 | 1.13 | 0.18 | 0 | 0.0108 | 0.0001 | 0.0033 | 0.0014 | — | 0.0043 | 174 |
| 5 | 0.21 | 0.19 | 0.82 | 0.015 | 0.016 | 0.46 | 0 | 0 | 1.12 | 0.17 | 0 | 0.0212 | 0.0002 | 0.0029 | 0.0015 | — | 0.0082 | 381 |
| 6 | 0.2 | 0.18 | 0.8 | 0.013 | 0.015 | 0.27 | 0 | 0 | 0.59 | 0.19 | 0 | 0.011 | 0.0001 | 0.0032 | 0.0005 | — | 0.0043 | 658 |
| 7 | 0.2 | 0.2 | 0.79 | 0.012 | 0.016 | 0.29 | 0 | 0 | 1.11 | 0.18 | 0 | 0.0111 | 0.0002 | 0.0027 | 0.0004 | — | 0.0009 | 1003 |
| 8 | 0.22 | 0.19 | 0.81 | 0.014 | 0.017 | 0.28 | 0 | 0 | 1.12 | 0.19 | 0 | 0.012 | 0.0001 | 0.0025 | 0.0006 | — | 0.0018 | 653 |
| 9 | 0.21 | 0.21 | 0.82 | 0.013 | 0.016 | 0.28 | 0 | 0 | 1.14 | 0.17 | 0 | 0.0113 | 0 | 0.0033 | 0.0007 | — | 0.0034 | 563 |
| 10 | 0.21 | 0.19 | 0.8 | 0.013 | 0.015 | 0.27 | 0 | 0 | 1.11 | 0.19 | 0 | 0.0097 | 0.0001 | 0.0025 | 0.001 | — | 0.0042 | 381 |
| 11 | 0.2 | 0.19 | 0.81 | 0.012 | 0.018 | 0.27 | 0 | 0 | 1.12 | 0.2 | 0 | 0.0103 | 0.0001 | 0.0028 | 0.0011 | — | 0.0017 | 347 |
| 12 | 0.19 | 0.18 | 0.81 | 0.014 | 0.017 | 0.28 | 0 | 0 | 1.13 | 0.18 | 0 | 0.0108 | 0 | 0.0021 | 0.0009 | — | 0.0127 | 437 |
| 13 | 0.2 | 0.2 | 0.82 | 0.015 | 0.017 | 0.26 | 0 | 0 | 1.13 | 0.17 | 0 | 0.0112 | 0.0002 | 0.0034 | 0.0011 | — | 0.0056 | 339 |
| 14 | 0.2 | 0.2 | 0.8 | 0.014 | 0.013 | 0.29 | 0 | 0 | 1.12 | 0.19 | 0 | 0.0092 | 0.0002 | 0.0026 | 0.0008 | — | 0.0078 | 503 |
| 15 | 0.21 | 0.2 | 0.8 | 0.014 | 0.015 | 0.28 | 0 | 0 | 1.11 | 0.19 | 0 | 0.0125 | 0.0001 | 0.0019 | 0.0006 | — | 0.0058 | 651 |
| 16 | 0.19 | 0.21 | 0.79 | 0.012 | 0.018 | 0.27 | 0 | 0 | 1.15 | 0.18 | 0 | 0.0132 | 0 | 0.0023 | 0.0015 | — | 0.0039 | 257 |
| 17 | 0.18 | 0.2 | 0.81 | 0.013 | 0.014 | 0.27 | 0 | 0 | 1.14 | 0.19 | 0 | 0.0104 | 0.0001 | 0.0022 | 0.001 | — | 0.0061 | 394 |
| 18 | 0.21 | 0.19 | 0.82 | 0.025 | 0.015 | 0.28 | 0 | 0 | 1.12 | 0.17 | 0 | 0.0101 | 0 | 0.002 | 0.0024 | — | 0.0044 | 163 |
| 19 | 0.21 | 0.19 | 0.81 | 0.012 | 0.017 | 0.28 | 0 | 0 | 1.13 | 0.03 | 0 | 0.0103 | 0.0002 | 0.0028 | 0.0019 | — | 0.0041 | 107 |
| 20 | 0.2 | 0.17 | 0.82 | 0.015 | 0.015 | 0.12 | 0 | 0 | 1.13 | 0.17 | 0 | 0.0102 | 0 | 0.0002 | 0.0017 | — | 0.0054 | 137 |
| 21 | 0.06 | 0.19 | 0.82 | 0.014 | 0.018 | 0.28 | 0 | 0 | 1.12 | 0.17 | 0 | 0.0105 | 0.0001 | 0.0035 | 0.0018 | — | 0.004 | 218 |
| 22 | 1.01 | 0.27 | 0.33 | 0.013 | 0.002 | 0.28 | 0 | 0 | 1.49 | 0 | 0 | 0.0085 | 0 | 0.0026 | 0.0006 | — | 0.0033 | 715 |

*Remainder: iron and inevitable impurities except for P and S.

TABLE 2

| Test | Steel Material Chemical Composition* (mass %) | | | | | | | | | | | | | | | | | |
|---|---|---|---|---|---|---|---|---|---|---|---|---|---|---|---|---|---|---|
| No. | C | Si | Mn | P | S | Al | Cu | Ni | Cr | Mo | V | N | Mg | Ca | O | Others | Solute N | A Value |
| 23 | 0.21 | 1.70 | 0.82 | 0.015 | 0.017 | 0.27 | 0 | 0 | 1.12 | 0.17 | 0 | 0.0045 | 0 | 0.0024 | 0.0013 | — | 0.0022 | 294 |
| 24 | 0.20 | 0.19 | 1.71 | 0.014 | 0.015 | 0.28 | 0 | 0 | 1.13 | 0.19 | 0 | 0.0127 | 0 | 0.0019 | 0.0010 | Nb: 0.014 | 0.0031 | 393 |
| 25 | 0.21 | 0.18 | 0.82 | 0.015 | 0.026 | 0.27 | 0 | 0 | 1.12 | 0.17 | 0 | 0.0149 | 0.0002 | 0.0020 | 0.0011 | Ti: 0.012 B: 0.0010 | 0.0035 | 347 |
| 26 | 0.20 | 0.18 | 0.82 | 0.014 | 0.015 | 0.29 | 0.07 | 1.55 | 1.13 | 0.18 | 0 | 0.0109 | 0.0001 | 0.0028 | 0.0018 | — | 0.0044 | 224 |
| 27 | 0.21 | 0.19 | 0.82 | 0.015 | 0.017 | 0.27 | 0 | 0 | 1.12 | 0.17 | 0.03 | 0.0168 | 0.0001 | 0.0029 | 0.0015 | — | 0.0033 | 255 |
| 28 | 0.45 | 0.21 | 0.76 | 0.013 | 0.015 | 0.28 | 0 | 0 | 0.12 | 0 | 0 | 0.0056 | 0 | 0.0025 | 0.0016 | — | 0.0022 | 183 |
| 29 | 0.29 | 0.19 | 0.55 | 0.014 | 0.019 | 0.27 | 0 | 2.70 | 0.80 | 0.89 | 0 | 0.0122 | 0.0003 | 0 | 0.0014 | — | 0.0046 | 250 |
| 30 | 0.31 | 0.20 | 0.54 | 0.015 | 0.016 | 0.27 | 0 | 0 | 2.88 | 0.44 | 0 | 0.0076 | 0.0002 | 0 | 0.0013 | — | 0.0032 | 429 |
| 31 | 0.18 | 0.21 | 0.04 | 0.013 | 0.024 | 0.21 | 0 | 0 | 1.08 | 0.11 | 0 | 0.0112 | 0.0002 | 0.0031 | 0.0011 | — | 0.0050 | 289 |
| 32 | 0.21 | 0.19 | 0.82 | 0.015 | 0.015 | 0.08 | 0 | 0 | 1.45 | 0.17 | 0 | 0.0103 | 0 | 0 | 0.0012 | — | 0.0059 | 188 |
| 33 | 0.20 | 0.18 | 0.81 | 0.015 | 0.014 | 0.03 | 0 | 0 | 1.34 | 0.18 | 0 | 0.0105 | 0.0001 | 0.0024 | 0.0018 | — | 0.0079 | 91 |
| 34 | 0.20 | 0.19 | 0.82 | 0.015 | 0.015 | 0.16 | 0 | 0 | 1.12 | 0.17 | 0 | 0.0018 | 0.0001 | 0.0019 | 0.0012 | — | 0.0003 | 127 |

TABLE 2-continued

| Test No. | Steel Material Chemical Composition* (mass %) C | Si | Mn | P | S | Al | Cu | Ni | Cr | Mo | V | N | Mg | Ca | O | Others | Solute N | A Value |
|---|---|---|---|---|---|---|---|---|---|---|---|---|---|---|---|---|---|---|
| 35 | 1.22 | 0.19 | 0.82 | 0.013 | 0.015 | 0.28 | 0 | 0 | 1.13 | 0.17 | 0 | 0.0108 | 0.0002 | 0.0029 | 0.0015 | — | 0.0043 | 262 |
| 36 | 0.20 | 2.10 | 0.82 | 0.015 | 0.015 | 0.27 | 0 | 0 | 1.12 | 0.18 | 0 | 0.0107 | 0.0001 | 0.0027 | 0.0016 | — | 0.0045 | 239 |
| 37 | 0.20 | 0.19 | 1.85 | 0.042 | 0.015 | 0.28 | 0 | 0 | 1.14 | 0.17 | 0 | 0.0110 | 0.0001 | 0.0029 | 0.0014 | — | 0.0043 | 281 |
| 38 | 0.21 | 0.18 | 0.82 | 0.015 | 0.040 | 0.27 | 0 | 0 | 1.12 | 0.19 | 0 | 0.0103 | 0 | 0.0008 | 0.0013 | — | 0.0042 | 294 |
| 39 | 0.20 | 0.19 | 0.82 | 0.014 | 0.015 | 0.60 | 0 | 0 | 1.12 | 0.17 | 0 | 0.0110 | 0.0001 | 0.0028 | 0.0010 | — | 0.0068 | 712 |
| 40 | 0.21 | 0.21 | 0.81 | 0.015 | 0.015 | 0.28 | 0 | 0 | 3.20 | 0.17 | 0 | 0.0101 | 0 | 0.0025 | 0.0014 | — | 0.0041 | 429 |
| 41 | 0.20 | 0.21 | 0.82 | 0.014 | 0.014 | 0.27 | 0 | 0 | 0.01 | 0.18 | 0 | 0.0109 | 0 | 0.0028 | 0.0015 | — | 0.0041 | 181 |
| 42 | 0.21 | 0.19 | 0.81 | 0.013 | 0.017 | 0.27 | 0 | 0 | 1.13 | 1.20 | 0 | 0.0103 | 0.0002 | 0.0026 | 0.0013 | — | 0.0039 | 295 |
| 43 | 0.20 | 0.20 | 0.82 | 0.015 | 0.016 | 0.29 | 0 | 0 | 1.12 | 0.18 | 0 | 0.0105 | 0 | 0.0027 | 0.0010 | — | 0.0001 | 402 |
| 44 | 0.21 | 0.19 | 0.82 | 0.013 | 0.015 | 0.12 | 0 | 0 | 1.14 | 0.17 | 0 | 0.0285 | 0.0001 | 0.0035 | 0.0008 | — | 0.0061 | 293 |
| 45 | 0.21 | 0.19 | 0.83 | 0.014 | 0.015 | 0.28 | 0 | 0 | 1.12 | 0.19 | 0 | 0.0103 | 0.0001 | 0.0031 | 0.0038 | | 0.0043 | 103 |

*Remainder: iron and inevitable impurities except for P and S.

The thus-obtained plate materials and the round bar materials were subjected to heat treatments shown in Tables 3 and 4 (heating time was 2 hours in each treatments) in order to use the plate materials and the round bar materials as materials for end mill test pieces and materials for Charpy impact test pieces. The forged materials were subjected to machinability evaluation in intermittent cutting and measurement of toughness in transverse direction (Charpy absorption energy) under the following conditions.

Evaluation of Machinability in Intermittent Cutting

In order to evaluate machinability in intermittent cutting, tool wear in end mill processing was evaluated. Each of the plate materials (annealed material) was subjected to scale elimination, and then a surface thereof was ground by about 2 mm to obtain an end mill test piece. Specifically, an end mill tool was attached to a machining center main shaft, and the sample having a thickness of 25 mm, a width of 150 mm, and a length of 100 mm produced as described above was fixed by a vise, followed by downward cutting under a dry cutting atmosphere. Detailed processing conditions are shown in Table 5. After performing 200 cuts of intermittent cuttings, an average flank wear width (tool wear amount) Vb was measured by an optical microscope. Results are shown in Tables 3 and 4. Those achieved Vb of 70 μm or less after the intermittent cutting were evaluated as being excellent in machinability in intermittent cutting (indicated by o). Also, a Vickers hardness Hv of a surface of each of the test pieces was measured, and the results are shown in Tables 3 and 4.

Toughness in Transverse Direction

A Charpy impact test piece (shape: 10 mm×10 mm×55 mm) having a notch shape of R10 (mm) along a direction perpendicular to the drawing direction (forging direction) was obtained by machining from each of the round bar materials, followed by carburizing-oil quenching under the following conditions and tempering (170° C.×120 minutes and air cooling), and a Charpy impact value (Charpy absorption energy E in transverse direction) was measured. The results are shown in Tables 3 and 4. Those achieved a Charpy impact value of 10.0 J or more were evaluated as being excellent in toughness in transverse direction (indicated by o).

Carburizing Conditions

930° C.×90 minutes ($CO_2$ concentration: 0.110%, carbon potential: targeted to 1.0%), 930° C.×90 minutes ($CO_2$ concentration: 0.170%, carbon potential: targeted to 0.8%), 840° C.×60 minutes ($CO_2$ concentration: 0.390%, carbon potential: targeted to 0.8%), oil quenching (cold oil: 60° C.), and (tempering: 170° C.×120 minutes).

TABLE 3

| Test No. | Heat Treament: Heating Temperature (° C.) | Cooling Rate (° C./sec) | Process Step | Experimental Results: Tool Wear Amount Vb (μm) | Judgment | Vickers Hardness (Hv) | Transverse direction Charpy Absorption E (J) | Judgment | Comprehensive Judgment |
|---|---|---|---|---|---|---|---|---|---|
| 1 | 1200 | 1.5 | Quenching | 76 | x | 165 | 14.1 | o | x |
| 2 | 1200 | 1.5 | Quenching | 65 | o | 168 | 15.2 | o | o |
| 3 | 1200 | 1.5 | Quenching and Hot Forging | 35 | o | 169 | 16.4 | o | o |
| 4 | 1200 | 1.5 | Quenching | 41 | o | 153 | 14.7 | o | o |
| 5 | 1200 | 1.5 | Quenching | 29 | o | 181 | 10.8 | o | o |
| 6 | 1200 | 1.5 | Quenching | 22 | o | 164 | 16.2 | o | o |
| 7 | 950 | 1.5 | Quenching | 83 | x | 134 | 15.5 | o | x |
| 8 | 1050 | 1.5 | Quenching | 74 | x | 146 | 15.4 | o | x |
| 9 | 1150 | 1.5 | Quenching | 24 | o | 165 | 12.3 | o | o |
| 10 | 1250 | 1.5 | Quenching | 23 | o | 166 | 11.9 | o | o |
| 11 | 1200 | 0.6 | Quenching | 77 | x | 140 | 14.8 | o | x |
| 12 | 1200 | 0.8 | Quenching | 29 | o | 151 | 13.2 | o | o |
| 13 | 1200 | 2 | Quenching | 43 | o | 173 | 12.6 | o | o |
| 14 | 1200 | 5 | Quenching | 81 | x | 218 | 8.9 | x | x |
| 15 | 1200 | 1.5 | Quenching and Hot Forging | 23 | o | 169 | 13.7 | o | o |
| 16 | 1150 | 1 | Quenching | 25 | o | 159 | 12.5 | o | o |
| 17 | 1250 | 3.5 | Quenching | 28 | o | 185 | 11.4 | o | o |
| 18 | 1200 | 1.5 | Quenching | 24 | o | 167 | 14 | o | o |

TABLE 3-continued

| Test No. | Heat Treament: Heating Temperature (° C.) | Heat Treament: Cooling Rate (° C./sec) | Heat Treament: Process Step | Experimental Results: Tool Wear Amount Vb (μm) | Tool Wear Amount Judgment | Vickers Hardness (Hv) | Transverse direction Charpy Absorption E (J) | Transverse direction Charpy Judgment | Comprehensive Judgment |
|---|---|---|---|---|---|---|---|---|---|
| 19 | 1200 | 1.5 | Quenching | 19 | ○ | 162 | 12.9 | ○ | ○ |
| 20 | 1200 | 1.5 | Quenching | 75 | x | 168 | 8.4 | x | x |
| 21 | 1200 | 1.5 | Quenching | 21 | ○ | 121 | 18.5 | ○ | ○ |
| 22 | 1200 | 1.5 | Quenching | 35 | ○ | 232 | 11.3 | ○ | ○ |

TABLE 4

| Test No. | Heat Treament: Heating Temperature (° C.) | Heat Treament: Cooling Rate (° C./sec) | Heat Treament: Process Step | Experimental Results: Tool Wear Amount Vb (μm) | Tool Wear Amount Judgment | Vickers Hardness (Hv) | Transverse direction Charpy Absorption E (J) | Transverse direction Charpy Judgment | Comprehensive Judgment |
|---|---|---|---|---|---|---|---|---|---|
| 23 | 1200 | 1.5 | Quenching | 38 | ○ | 215 | 12.4 | ○ | ○ |
| 24 | 1200 | 1.5 | Quenching | 52 | ○ | 295 | 11.8 | ○ | ○ |
| 25 | 1200 | 1.5 | Quenching | 19 | ○ | 154 | 16.3 | ○ | ○ |
| 26 | 1200 | 1.5 | Quenching | 26 | ○ | 175 | 15.2 | ○ | ○ |
| 27 | 1200 | 1.5 | Quenching | 25 | ○ | 145 | 14.9 | ○ | ○ |
| 28 | 1200 | 1.5 | Quenching | 48 | ○ | 158 | 15.2 | ○ | ○ |
| 29 | 1200 | 1.5 | Quenching | 31 | ○ | 171 | 16.7 | ○ | ○ |
| 30 | 1200 | 1.5 | Quenching | 61 | ○ | 284 | 10.7 | ○ | ○ |
| 31 | 1200 | 1.5 | Quenching | 59 | ○ | 132 | 5.8 | x | x |
| 32 | 1200 | 1.5 | Quenching | 73 | x | 168 | 7.8 | x | x |
| 33 | 1200 | 1.5 | Quenching and Hot Forging | 95 | x | 162 | 15.8 | ○ | x |
| 34 | 1200 | 1.5 | Quenching | 84 | x | 128 | 16.7 | ○ | x |
| 35 | 1200 | 1.5 | Quenching | 116 | x | 258 | 8.0 | x | x |
| 36 | 1200 | 1.5 | Quenching | 65 | ○ | 248 | 6.5 | x | x |
| 37 | 1200 | 1.5 | Quenching | 104 | x | 315 | 5.9 | x | x |
| 38 | 1200 | 1.5 | Quenching | 42 | ○ | 174 | 6.1 | x | x |
| 39 | 1200 | 1.5 | Quenching | 35 | ○ | 172 | 9.2 | x | x |
| 40 | 1200 | 1.5 | Quenching | 98 | x | 297 | 9.0 | x | x |
| 41 | 1200 | 1.5 | Quenching | 78 | x | 141 | 15.6 | ○ | x |
| 42 | 1200 | 1.5 | Quenching | 76 | x | 213 | 12.5 | ○ | x |
| 43 | 1200 | 1.5 | Quenching | 114 | x | 120 | 17.5 | ○ | x |
| 44 | 1200 | 1.5 | Quenching | 56 | ○ | 332 | 7.1 | x | x |
| 45 | 1200 | 1.5 | Quenching | 117 | x | 163 | 9.2 | x | x |

TABLE 5

| Intermittent Cutting Conditions | |
|---|---|
| **Cutting Tool** | |
| Model number | K-2SL; High speed end mill manufactured by Mitsubishi Materials Corporation |
| Outer diameter | ϕ10.0 mm |
| Coating | TiAlN coating |
| **Cutting Conditions** | |
| Axial direction notch amount | 1.0 mm |
| Radial direction notch amount | 1.0 mm |
| Feed amount | 0.117 mm/rev |
| Feed speed | 558.9 mm/min |
| Cutting speed | 150 m/min |
| Number of rotations | 4777 rpm |
| Cutting atmosphere | Dry |

As is apparent from the above results, the sample Nos. 2 to 6, 9, 10, 12, 13, 15 to 19, and 21 to 30 that satisfy the requirements of the invention achieve a small tool wear amount Vb after intermittent cutting, have excellent machinability in intermittent cutting, and exhibit excellent toughness in transverse direction (Comprehensive Judgment: o).

In contrast, the sample Nos. 1, 7, 8, 11, 14, 20, 31 to 45 do not satisfy the requirements of the invention (Comprehensive Judgment: x). These samples are increased in tool wear amount after intermittent cutting (test Nos. 1, 7, 8, 11, 14, 20, 32 to 35, 37, 40 to 43, and 45) or reduced in toughness in transverse direction (test Nos. 14, 20, 31, 32, 35 to 40, 44, and 45).

Figure 2:
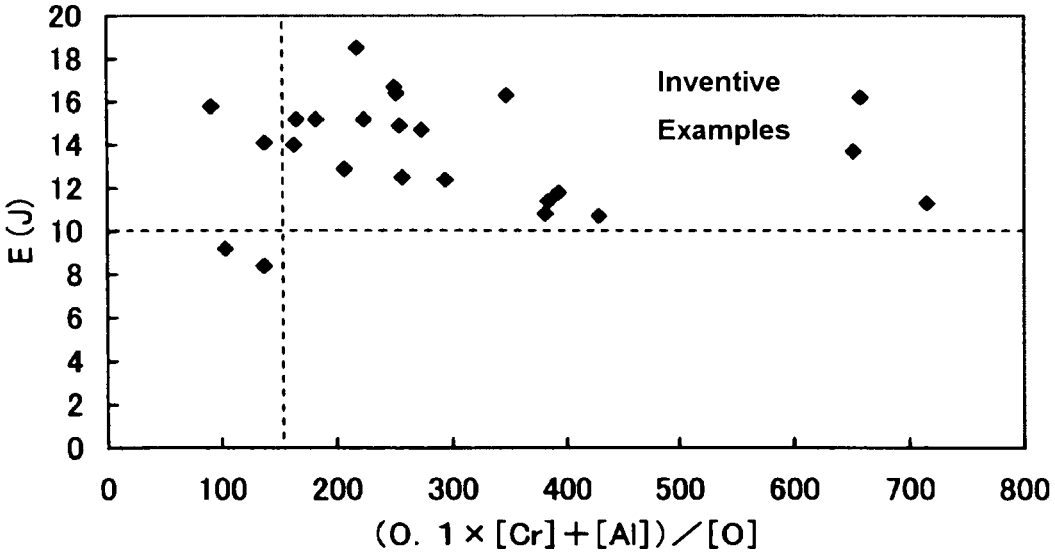
FIG. 2 is a graph showing a relationship between the value A {(0.1×[Cr]+[Al]/[O])} and a Charpy absorption energy E in transverse direction.

Based on the above results, relationships between the value A $\{(0.1\times[Cr]+[Al]/[O])\}$ and a tool wear amount Vb and toughness in transverse direction (Charpy absorption energy E in transverse direction) in the test Nos. 1 to 6, to 30, 33, and 45 are shown in Table 6. Also, based on the data, a relationship between the value A and the tool wear amount Vb is shown in FIG. 1, and a relationship between the value A and the Charpy absorption energy E in transverse direction is shown in FIG. 2. From these graphs, it is revealed that the steels for machine and structural uses of the invention examples exhibit excellent machinability and toughness when the relationship of the expression (1) is satisfied (i.e. when the value A is appropriately adjusted).

TABLE 6

| Test No. | Value A | Experimental Results: Tool Wear Amount Vb (μm) | Experimental Results: Charpy Impact Value in Transverse direction (J) | Comprehensive Judgment |
|---|---|---|---|---|
| 1 | 138 | 76 | 14.1 | x |
| 2 | 165 | 65 | 15.2 | ○ |
| 3 | 252 | 35 | 16.4 | ○ |
| 4 | 274 | 41 | 14.7 | ○ |
| 5 | 381 | 29 | 10.8 | ○ |
| 6 | 658 | 22 | 16.2 | ○ |
| 15 | 652 | 23 | 13.7 | ○ |
| 16 | 257 | 25 | 12.5 | ○ |
| 17 | 384 | 28 | 11.4 | ○ |
| 18 | 163 | 24 | 14.0 | ○ |
| 19 | 207 | 19 | 12.9 | ○ |
| 20 | 137 | 75 | 8.4 | x |
| 21 | 218 | 21 | 18.5 | ○ |
| 22 | 715 | 35 | 11.3 | ○ |
| 23 | 294 | 38 | 12.4 | ○ |
| 24 | 393 | 52 | 11.8 | ○ |
| 25 | 347 | 19 | 16.3 | ○ |
| 26 | 224 | 26 | 15.2 | ○ |
| 27 | 255 | 25 | 14.9 | ○ |
| 28 | 183 | 48 | 15.2 | ○ |
| 29 | 250 | 31 | 16.7 | ○ |
| 30 | 429 | 61 | 10.7 | ○ |
| 33 | 91 | 95 | 15.8 | x |
| 45 | 103 | 117 | 9.2 | x |

Although the present invention was described in detail or with reference to the specific examples as described in the foregoing, it is apparent for those skilled in the art that it is possible to add various alterations and modifications to this invention insofar as the alternations and modifications do not deviate from the spirit and scope of this invention. This application is based on Japanese patent application (Patent Application No. 2007-170936) filed on Jun. 28, 2007, and contents of which are incorporated herein by reference.

The invention claimed is:

1. A steel comprising, by mass %, 0.05 to 1.2% of C, 0.03 to 2% of Si, 0.2 to 1.8% of Mn, at most 0.03% and greater than 0% of P, at most 0.03% and greater than 0% of S, 0.1 to 3% of Cr, 0.3 to 0.5% of Al, 0.004 to 0.025% of N, at most 0.003% and greater than 0% of O, at least one of 0.0005 to 0.02% of Ca and 0.0001 to 0.005% of Mg, and 0.002% or more of solute N in the steel, with a remainder being iron and inevitable impurities, wherein the steel satisfies a relationship of expression (1):

$$(0.1 \times [Cr]+[Al])/[O] \geqq 150 \quad (1),$$

wherein [Cr], [Al], and [O] represent a Cr content (mass %), an Al content (mass %), and an O content (mass %), respectively.

2. The steel according to claim 1, further comprising, by mass %, at most 1.0% and greater than 0% of Mo.

3. The steel according to claim 1, further comprising, by mass %, at most 0.15% and greater than 0% of Nb.

4. The steel according to claim 1, further comprising, by mass %, at least one element selected from the group consisting of Ti, Zr, Hf, and Ta in a total content of at most 0.02% and greater than 0%.

5. The steel according to claim 1, further comprising, by mass %, at least one of:

at most 0.5% and greater than 0% of V, at most 3% and greater than 0% of Cu, at most 3% and greater than 0% of Ni, and at most 0.005% and greater than 0% of B.

6. The steel according to claim 2, further comprising, by mass %, at most 0.15% and greater than 0% of Nb.

7. The steel according to claim 1, wherein the amount of Cr is from 0.3% to 2.0% by mass %.

8. The steel according to claim 1, wherein the amount of Cr is from 0.7% to 1.6% by mass %.

9. The steel according to claim 1, wherein the amount of O is at most 0.002% and greater than 0% by mass %.

10. The steel according to claim 1, which has an average flank wear width of 70 μm or less.

11. The steel according to claim 1, which has a Charpy impact value of 10.0 J or more.

12. A process for producing a steel, said process comprising, as a solution treatment of solute N, heating a steel material to 1150° C. or more, followed by cooling the steel material in a temperature range of from 900 to 500° C. at a cooling rate of from 0.8 to 4° C./sec, resulting in the steel of claim 1.

13. The process of claim 12, wherein the cooling rate is from 0.9 to 2.0° C./sec.

* * * * *